US007643002B2

(12) United States Patent
Kang et al.

(10) Patent No.: US 7,643,002 B2
(45) Date of Patent: Jan. 5, 2010

(54) DATA DRIVER, LIQUID CRYSTAL DISPLAY AND DRIVING METHOD THEREOF

(75) Inventors: Sin Ho Kang, Suwon-shi (KR); Jin Cheol Hong, Kumi-shi (KR); Sung Chul Ha, Gyeongsangbuk-do (KR)

(73) Assignee: LG. Display Co., Ltd., Seoul (KR)

( * ) Notice: Subject to any disclaimer, the term of this patent is extended or adjusted under 35 U.S.C. 154(b) by 640 days.

(21) Appl. No.: 11/320,387

(22) Filed: Dec. 27, 2005

(65) Prior Publication Data

US 2006/0291298 A1 Dec. 28, 2006

(30) Foreign Application Priority Data

Jun. 28, 2005 (KR) ..... 10-2005-0056542

(51) Int. Cl.
*G09G 3/36* (2006.01)

(52) U.S. Cl. ..... 345/100; 345/89

(58) Field of Classification Search ..... 345/87, 345/89, 95, 96, 100; 365/189.05
See application file for complete search history.

(56) References Cited

U.S. PATENT DOCUMENTS 5,600,345 A * 2/1997 Dingwall et al. ..... 345/100
6,266,039 B1 * 7/2001 Aoki ..... 345/94
6,909,414 B2 * 6/2005 Tsuchi et al. ..... 345/89
2002/0011979 A1 * 1/2002 Nitta et al. ..... 345/89
2004/0095306 A1 * 5/2004 Fujiyoshi ..... 345/94
2005/0007324 A1 * 1/2005 Inada ..... 345/87

FOREIGN PATENT DOCUMENTS

CN 1489375 4/2004
CN 1523551 8/2004

OTHER PUBLICATIONS

First Office Action for corresponding Chinese Patent Application Serial No. 2005101340406, dated Dec. 21, 2007.

* cited by examiner

*Primary Examiner*—Chanh Nguyen
*Assistant Examiner*—Ram A Mistry
(74) *Attorney, Agent, or Firm*—Brinks Hofer Gilson & Lione

(57) ABSTRACT

A liquid crystal display device includes a comparator which judges a voltage of data; and a pre-charge controller which pre-charges a data line of a liquid crystal display panel with a pre-charge voltage if the voltage of the data is a first voltage, and pre-charges the data line with a charge share voltage, which has a lower absolute value than the pre-charge voltage, if the voltage of the data is a second voltage that is lower than the first voltage.

12 Claims, 12 Drawing Sheets

DMUX TRUTH TABLE

| D7 ($2^7$) | D6 ($2^6$) | D5 ($2^5$) | S1 |
|---|---|---|---|
| 1 | 1 | 1 | 1 |
| 1 | 1 | 0 | 0 |
| 1 | 0 | 1 | 0 |
| 1 | 0 | 0 | 0 |
| 0 | 1 | 1 | 0 |
| 0 | 1 | 0 | 0 |
| 0 | 0 | 1 | 0 |
| 0 | 0 | 0 | 0 |

DMUX TRUTH TABLE

| Input | | Out put | | | |
|---|---|---|---|---|---|
| S1 | S0 | M0 | M1 | M2 | M3 |
| 0 | 0 | 1 | 0 | 0 | 0 |
| 0 | 1 | 0 | 1 | 0 | 0 |
| 1 | 0 | 0 | 0 | 1 | 0 |
| 1 | 1 | 0 | 0 | 0 | 1 |

DMUX TRUTH TABLE

| D7 ($2^7$) | D6 ($2^6$) | D5 ($2^5$) | S1 |
|---|---|---|---|
| 1 | 1 | 1 | 1 |
| 1 | 1 | 0 | 1 |
| 1 | 0 | 1 | 1 |
| 1 | 0 | 0 | 0 |
| 0 | 1 | 1 | 0 |
| 0 | 1 | 0 | 0 |
| 0 | 0 | 1 | 0 |
| 0 | 0 | 0 | 0 |

DMUX TRUTH TABLE

| D7 ($2^7$) | D6 ($2^6$) | S1 |
|---|---|---|
| 0 | 0 | 0 |
| 0 | 1 | 0 |
| 1 | 0 | 0 |
| 1 | 1 | 1 |

DMUX TRUTH TABLE

| D7 ($2^7$) | D6 ($2^6$) | D5 ($2^5$) | S1 |
|---|---|---|---|
| 1 | 1 | 1 | 1 |
| 1 | 1 | 0 | 0 |
| 1 | 0 | 1 | 0 |
| 1 | 0 | 0 | 0 |
| 0 | 1 | 1 | 0 |
| 0 | 1 | 0 | 0 |
| 0 | 0 | 1 | 0 |
| 0 | 0 | 0 | 0 |

DATA DRIVER, LIQUID CRYSTAL DISPLAY AND DRIVING METHOD THEREOF

This application claims the benefit of the Korean Patent Application No. P2005-56542 filed on Jun. 28, 2005, which is hereby incorporated by reference.

TECHNICAL FIELD

The present application relates to a liquid crystal display device, and more particularly to a liquid crystal display device that is adaptive for lowering an operating temperature of a data integrated circuit and reducing power consumption, and a driving method thereof.

BACKGROUND

A liquid crystal display device controls a light transmittance of liquid crystal cells in accordance with a video signal, thereby displaying a picture.

An active matrix type liquid crystal display device is advantageous in realizing a motion picture because it is possible to actively control a switching device. A thin film transistor (TFT) is used as a switching device used in the active matrix type liquid crystal display device.

As shown in FIG. 1, The liquid crystal display device includes a liquid crystal display panel 2 where a plurality of data lines 5 and a plurality of gate lines 6 cross each other and of TFTs are respectively formed at the crossing parts thereof for driving liquid crystal cells; a data driver 3 for supplying data to the data lines 5; a gate driver 4 for supplying a scan pulse to the gate lines 6; and a timing controller 1 for controlling the data driver 3 and the gate driver 4.

The liquid crystal display panel 2 has a liquid crystal injected between two glass substrates, and the data lines 5 and the gate lines 6 perpendicularly cross each other on a lower glass substrate. The TFT formed at the crossing part of the data line 5 and the gate line 6 supplies the data from the data line 5 to the liquid crystal cell in response to the scan pulse from the gate line 6. A gate electrode of the TFT is connected to the gate line 6 and a source electrode is connected to the data line 5. A drain electrode of the TFT is connected to a pixel electrode of the liquid crystal cell Clc. Further, a storage capacitor Cst is formed on the lower glass substrate of the liquid crystal display panel 2 for sustaining a voltage of the liquid crystal cell.

The timing controller 1 receives digital video which may be in the red-green-blue (RGB) data format, a horizontal synchronization signal H, a vertical synchronization signal V, and a clock signal CLK. The timing controller 1 generates a gate control signal GDC for controlling the gate driver 4 and a data control signal DDC for controlling the data driver 3. Further, the timing controller 1 supplies the RGB data to the data driver 3. The data control signal DDC includes a source shift clock SSC, a source start pulse SSP, a polarity control signal POL, a source output enable signal SOE, and is supplied to the data driver 3. The gate control signal GDC includes a gate start pulse GSP, a gate shift clock GSC, a gate output enable signal GOE, and is supplied to the gate driver 4.

The gate driver 4 includes a shift register which sequentially generates the scan pulse in response to the gate control signal GDC from the timing controller 1; a level shifter for shifting a swing width of the scan pulse to a level which is suitable for driving the liquid crystal cell Clc; and an output buffer. The gate driver 4 supplies the scan pulse to the gate line 6, thereby turning on the TFTs connected to the gate line 6 to select the liquid crystal cells Clc of one horizontal line to which a pixel voltage of the data, for example, an analog gamma compensation voltage, is to be supplied. The data generated by the data driver 3 are supplied to the liquid crystal cells Clc of the horizontal line which is selected by scan pulse.

The data driver 3 supplies the data to the data lines 5 in response to the data drive control signal DDC supplied from the timing controller 1. The data driver 3 samples the digital data RGB from the timing controller 1, latches the data, and then converts the data to into an analog gamma voltage. The data driver 3 is realized as a plurality of data integrated circuits (IC) 3*a* having the configuration as in FIG. 2.

Each of the data IC 3*a*, as shown in FIG. 2, includes a data register 21 to which the digital data RGB is inputted from the timing controller 1; a shift register 22 for generating a sampling clock; a first latch 23, a second latch 24, a digital/analog converter (DAC)25 and an output circuit 26 which are connected between the shift register 22 and k data lines DL1 to DLk; and a gamma voltage supplier 27 connected between a gamma reference voltage generator and the DAC 25.

The data register 21 supplies the digital data RGB from the timing controller 1 to the first latch 23. The shift register 22 shifts the source start pulse SSP from the timing controller 1 in accordance with the source sampling clock SSC to generate a sampling signal. Further, the shift register 22 shifts the source start pulse SSP to transmit a carry signal CAR to the shift register 22 of the next stage. The first latch 23 sequentially samples the digital data RGB from the data register 21 in response to the sampling signal sequentially inputted from the shift register 22. The second latch 24 latches the data inputted from the first latch 23, and then simultaneously outputs the latched data in response to the source output enable signal SOE from the timing controller 1. The DAC 25 converts the data from the second latch 24 into gamma voltages using reference voltages DGH and DGL from the gamma voltage suppler 27. The gamma voltages DGH and DGL are analog voltages corresponding to the gray levels of the digital input data. The output circuit 26 includes an output buffer connected to each of the data lines. The gamma voltage supplier 27 subdivides the gamma reference voltages GH and GL to supply the gamma voltage corresponding to each gray level to the DAC 25.

The data IC 3*a* has its load increased, driving frequency and the amount of generated heat is increased as liquid crystal display devices have increased in size and fidelity. Due to the heat generated by the data IC 3*a*, the reliability of the data IC 3*a* is decreases. A major source of the generation of heat in the data IC 3*a* is the output buffer 26*a*, shown in FIG. 3. The data IC 3*a* generates the heat by power consumption due to currents Isource and Isink flowing through internal resistive components of the output buffer 26*a*.

In order to improve the charging characteristics of the liquid crystal cell and to reduce power consumption, the data IC is being realized by a charge share method where the data voltage is supplied to each data line in a state where the data lines are disconnected after the adjacent data lines are connected to pre-charge the data line with a charge share voltage generated due to a charge share between the data lines, or by a pre-charge method where the data voltage is supplied to the data line after the data line is pre-charged with a pre-charge voltage being a pre-set external voltage.

In the charge share method, as shown in FIG. 4, currents flow in the output buffer 26*a* in an output buffer driving section where it is changed from a charge share voltage Vshare to a data voltage, and thus the heat generation and the power consumption are increased. In the pre-charge method, as shown in FIG. 5, a voltage of a driving area of the output buffer 26*a* is reduced due to the pre-charge voltage +Vpre or −Vpre supplied in advance as a relatively high external voltage when the data voltage is high, e.g., a white voltage in a normally black sequence, thereby decreasing the temperature of the data IC 3*a*. But, the temperature of the data IC 3*a* is increased and the power consumption is rapidly increased in the pre-charge driving area 51, 52 of the low data voltage due to the pre-charge voltage +Vpre or −Vpre supplied from the outside, where it is high, for data voltage which is a mean value or less.

SUMMARY

A liquid crystal display device includes a comparator configured to determine a value of a data element with respect to a threshold, and first and second supply voltages. The first supply voltage is connected to a data line when the value of the data element is greater than the threshold, and a second supply voltage is connected to the data line when the value of the data element is less than the threshold. In an aspect, a third supply voltage is connected to the data line in place of the first supply voltage when a polarity select voltage represents a negative state, selected from a positive and a negative state. The third supply voltage is less than the first and the second supply voltage.

In an aspect, a liquid crystal display device includes a comparator which determines a value of the data; and a pre-charge controller which pre-charges a data line of a liquid crystal display panel with a pre-charge value if the value of the data is a first value, and pre-charges the data line with a charge share voltage, which has a lower absolute value than the pre-charge voltage, if the value of the data is a second value that is lower than the first value.

The comparator and the pre-charge controller may be embedded within a data integrated circuit for driving the data line.

The pre-charge controller includes a source output enable signal and a polarity control signal for controlling a polarity of the data value, which are inputted thereto; a de-multiplexer which outputs the source output enable signal to anyone of a plurality of output terminals in accordance with an output of the comparator and an output of the polarity control signal; a first transistor for supplying the charge share voltage to the data line in accordance with the output of the de-multiplexer if the data value is the second value; a second transistor for supplying a positive pre-charge voltage to the data line in accordance with the output of the de-multiplexer if the data value is the first value; and a third transistor for supplying a negative pre-charge voltage to the data line in accordance with the output of the de-multiplexer if the data value is the first value.

The charge share voltage may include at least two or more charge share voltages of which voltages are different from each other within a voltage range that is lower in absolute value than the pre-charge voltage.

A method of operating a driver is disclosed, the method including the steps of: determining the value of a data element with respect to a threshold; determining the value of a polarity signal, the polarity signal having a value representing a positive voltage and a value representing a negative voltage; applying a first voltage to a data line if the value of the data element is greater than or equal to the threshold and the value of the polarity signal represents the positive voltage; applying a second voltage to a data line if the value of the data element is less than the threshold; and, applying a third voltage to a data line if the value of the data element is greater than or equal to the threshold and the value of the polarity signal represents the negative voltage.

In an aspect, a driving method of a liquid crystal display device includes the steps of judging a value of data; pre-charging a data line of a liquid crystal display panel with a pre-charge voltage if the value of the data is a first value; and pre-charging the data line with a charge share voltage which is lower in absolute value than the pre-charge voltage if the value of the data is a second value which is lower than the first value.

In the driving method, the charge share voltage may include at least two or more charge share voltages of which voltages are different from each other within a voltage range that is lower in absolute value than the pre-charge voltage.

DETAILED DESCRIPTION

Exemplary embodiments may be better understood with reference to the drawings, but these examples are not intended to be of a limiting nature. Like numbered elements in the same or different drawings perform equivalent functions.

Figure 1:
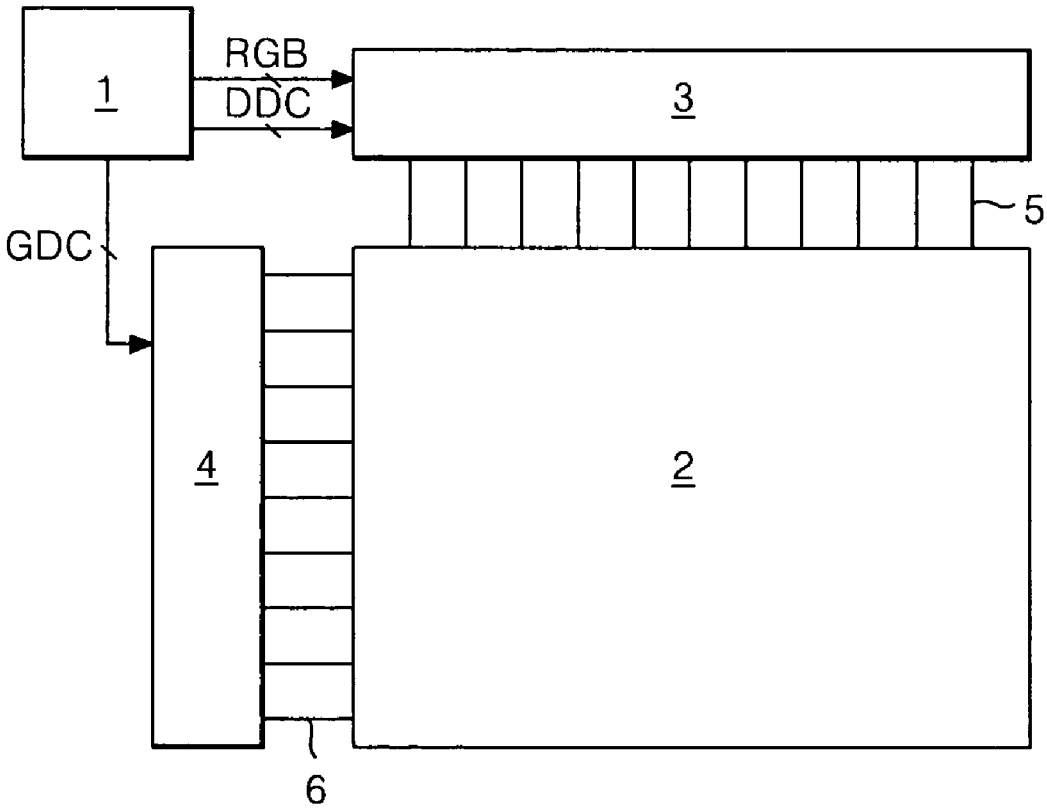
FIG. 1 RELATED ART
FIG. 1 a block diagram representing a liquid crystal display device.
Figure 2:
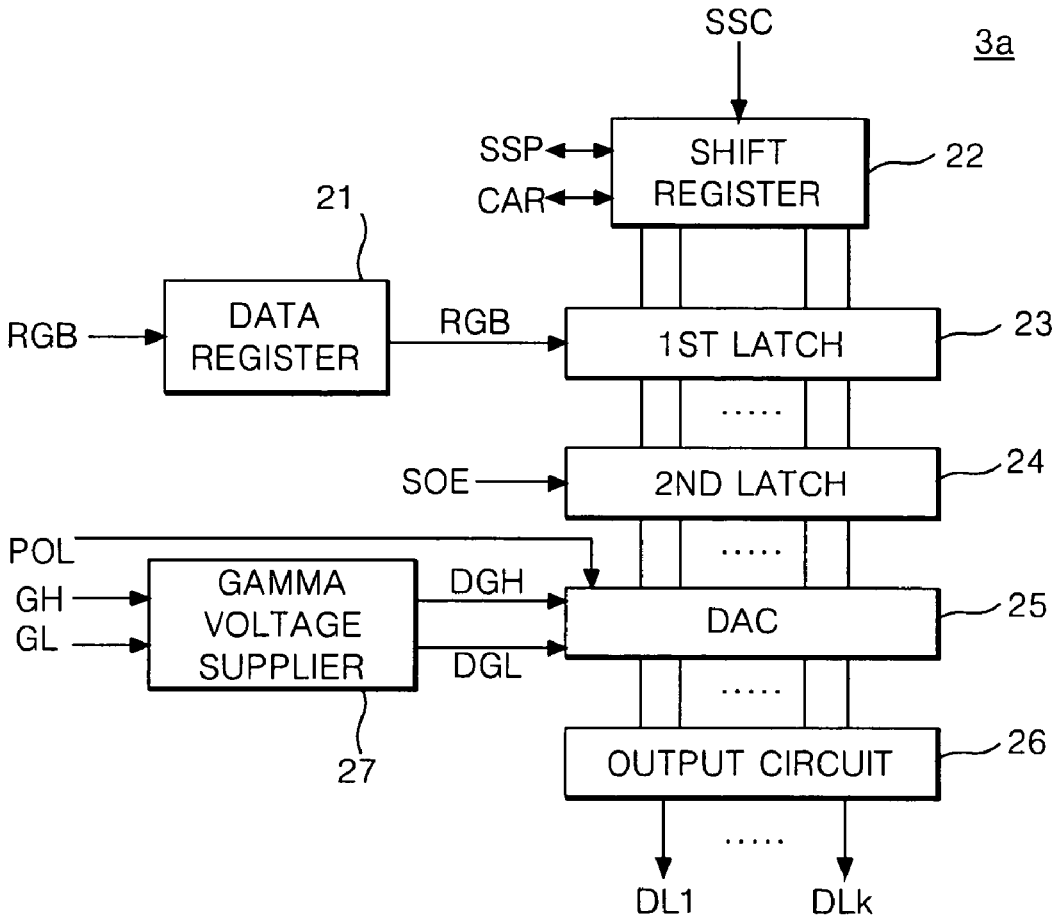
FIG. 2 RELATED ART
FIG. 2 is a block diagram showing details of the data driver shown in FIG. 1.
Figure 3:
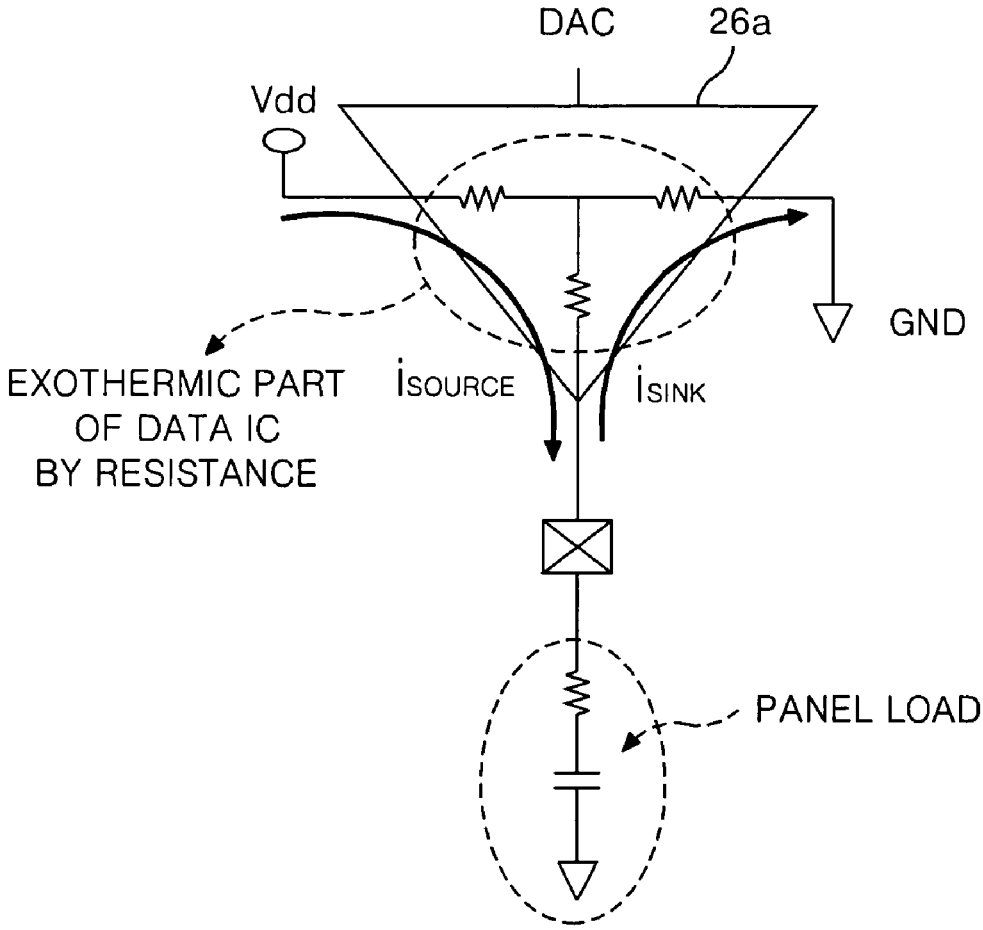
FIG. 3 RELATED ART
FIG. 3 is a circuit diagram showing an internal resistor within an output buffer and a current flowing through the internal resistor.
Figure 4:
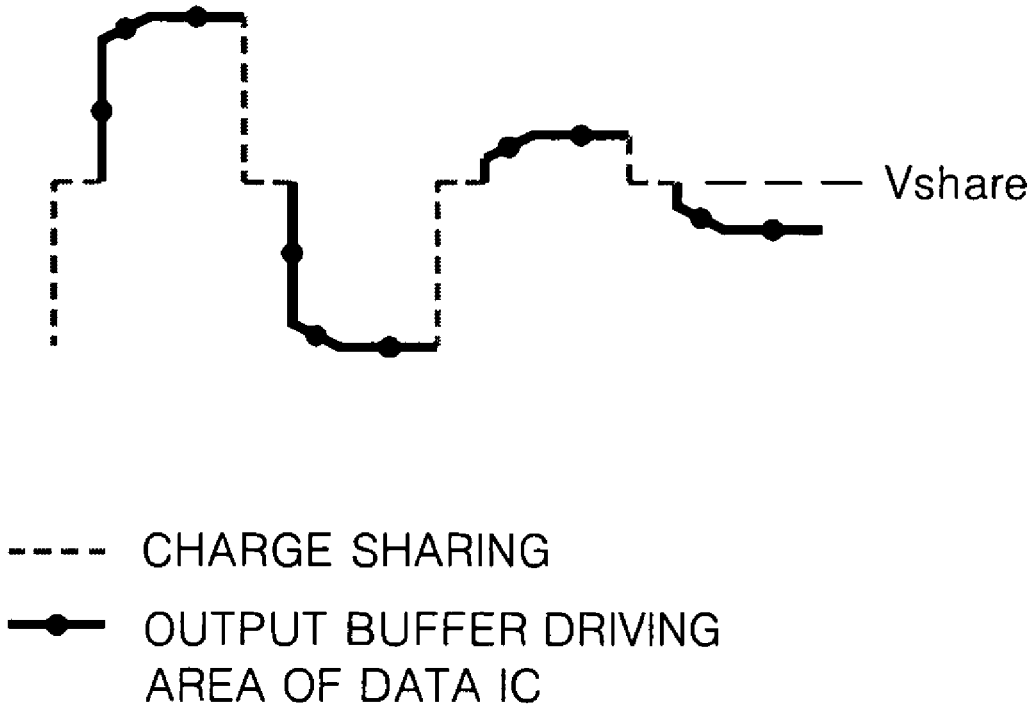
FIG. 4 RELATED ART
FIG. 4 is a waveform diagram showing an example of a pre-charging method where a data line is pre-charged with an external pre-charge voltage.
Figure 5:
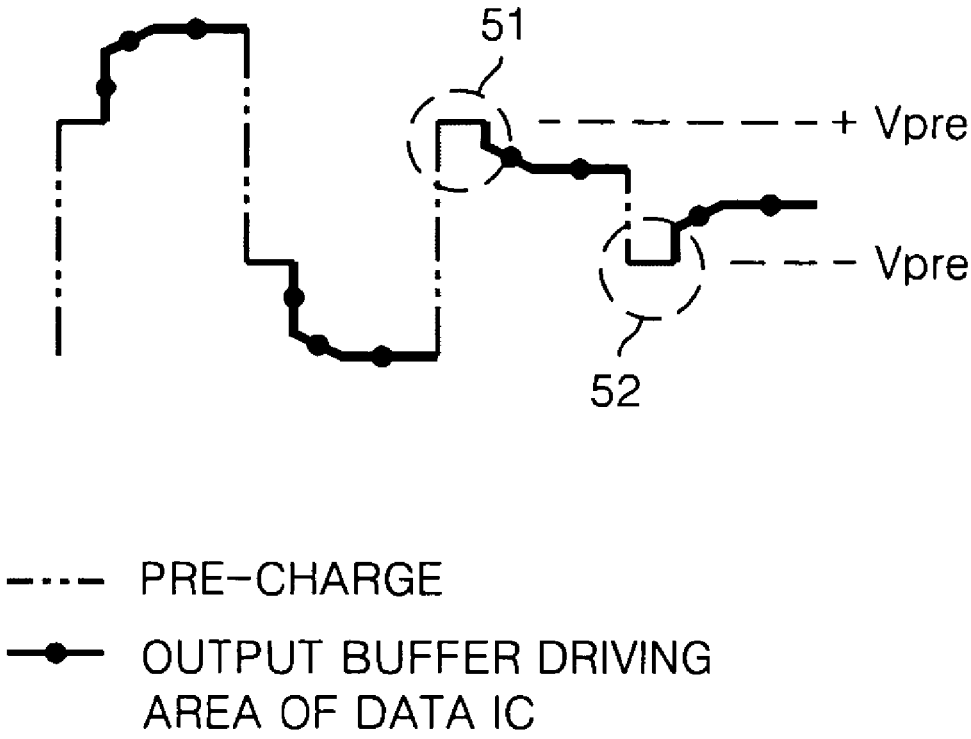
FIG. 5 RELATED ART
FIG. 5 is a waveform diagram showing an example of a charge share method where a data line is pre-charged with a charge share voltage.
Figure 6:
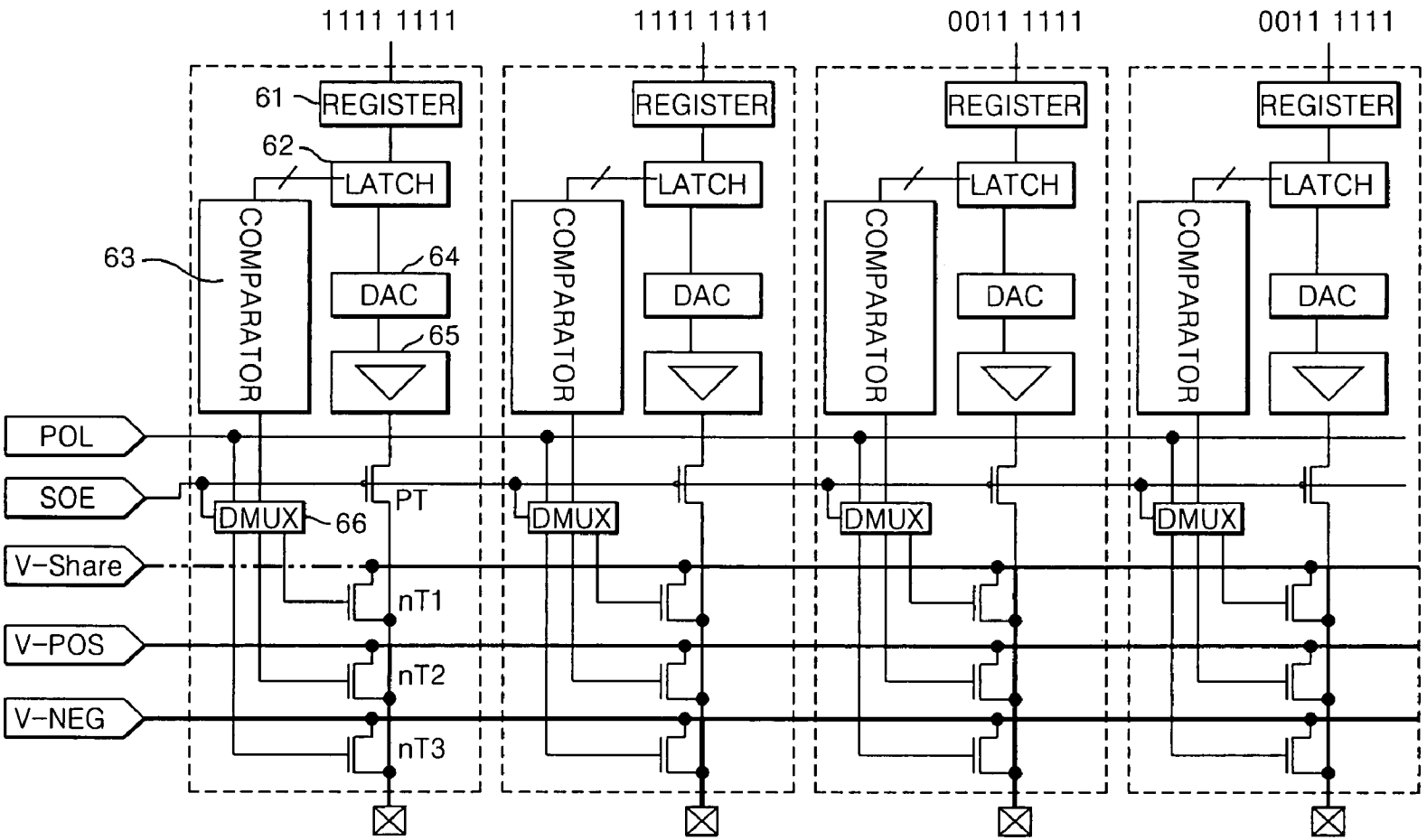
FIG. 6 is a circuit diagram representing an analog sampling device of a liquid crystal display device.

A data IC of a liquid crystal display device, in an example as shown in FIG. 6, includes a data register 61, a latch 62, a comparator 63, a digital-to-analog (DAC) 64, an output buffer 65, and a de-multiplexer (DMUX) 66.

The data register 61 supplies digital data from a timing controller to the latch 62. The latch 62 sequentially latches the digital data from the data register 61 in response to a sampling signal sequentially inputted from the shift register, and then simultaneously outputs them so as to convert serial data into parallel data. The DAC 64 converts the data from the latch 62 into an analog gamma voltage. The output buffer 65 supplies the analog voltage from the DAC 64 to a drain terminal of a p-type transistor. The p-type transistor pT is turned on during a low logic portion of a source output enable signal SOE to output the analog data voltage from the output buffer 65 to the data line of the liquid crystal display panel.

The comparator 63 receives the data from the latch 62 to determine the gray level value of the digital data and controls the DMUX 66 in accordance with the a value of the digital data. The comparator 63 generates an output signal of high logic value when a data value is high, e.g., white gray level voltage or a voltage close to the white gray level voltage, but the comparator 63 generates an output signal of low logic value when the data value is relatively low, e.g., a black gray level voltage or a voltage close to the black level voltage.

In an example, a time interval in which the data value is relatively high may be any one of a gray level value of 127 gray level or more, a value of 160 gray level or more, a value of 191 gray level or more, or a value of 224 gray level or more, assuming that the digital data may include 8 bits so that the number of expressible gray levels is 256. A time interval where the data voltage may be relatively low is a value of less than 127 gray level, a value of less than 160 gray level, a value of less than 191 gray level, or a value of less than 224 gray level, respectively. The comparator 63 has the number of upper bits and a circuit configuration in accordance with the desired gray levels to be distinguished.

Figure 7:
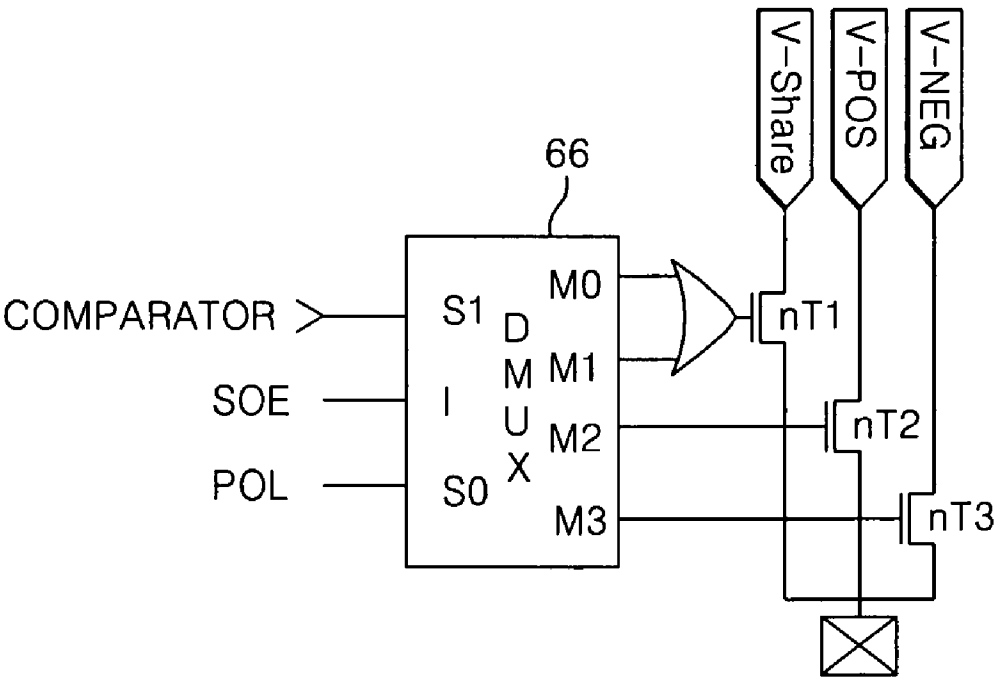
FIG. 7 is a circuit diagram representing a de-multiplexer shown in FIG. 6 in detail.

The DMUX 66, as shown in FIG. 7, outputs the source output enable signal SOE to any one of a plurality of output terminals M0 to M3 in accordance with the output signal and a polarity control signal POL. The OR gate is connected to the first and second output terminals M0 and M1 of the DMUX 66. The output terminal of the OR gate is connected to a gate terminal of a first n-type transistor nT1. The DMUX 66, which may be configured in accordance with, for example, the truth table of FIG. 7, and supplies the source output enable signal SOE of high logic level to the gate terminal of the first n-type transistor nT1 through the OR gate when the output signal of the comparator 63 is a low logical level. This occurs when the data voltage is a low absolute voltage value, irrespective of a logical value of the polarity control signal POL, thereby supplying a charge share voltage VShare, which is lower in absolute value than a pre-charge voltage V-POS or V-NEG, to the data line of the liquid crystal display panel. The DMUX 66 supplies the source output enable signal SOE of high logic level to a gate terminal of a second n-type transistor nT2 when the voltage of the output signal is the high logic voltage and the voltage of the polarity control signal POL is the low logic voltage. This occurs when the data voltage is the relatively high voltage and the polarity thereof is positive, thereby supplying a positive pre-charge voltage V-POS to the data line of the liquid crystal display panel. Further, the DMUX 66 supplies the source output enable signal SOE of high logic voltage to a gate terminal of a third n-type transistor nT3 when the voltage of the output signal is the high logic voltage and the voltage of the polarity control signal POL is the high logic voltage, This occurs when the data voltage is the relatively high voltage and the polarity thereof is negative, thereby supplying a negative pre-charge voltage V-NEG to the data line of the liquid crystal display panel. The DMUX 66, the transistors pT, nT1, nT2, nT3 and the control/driving voltages POL, SOE, V-Share, V-POS, V-NEG act as a pre-charge controller which controls the pre-charge of the data line.

The charge share voltage V-Share can be separately generated in a power supply circuit disposed outside of the data IC and can be a voltage which is generated by a charge sharing of the data lines within the data IC. The charge share voltage V-Share can be divided into two or more voltages within a voltage range which is lower than the positive pre-charge voltage V-POS and higher than the negative pre-charge voltage V-NEG.

Figure 8:
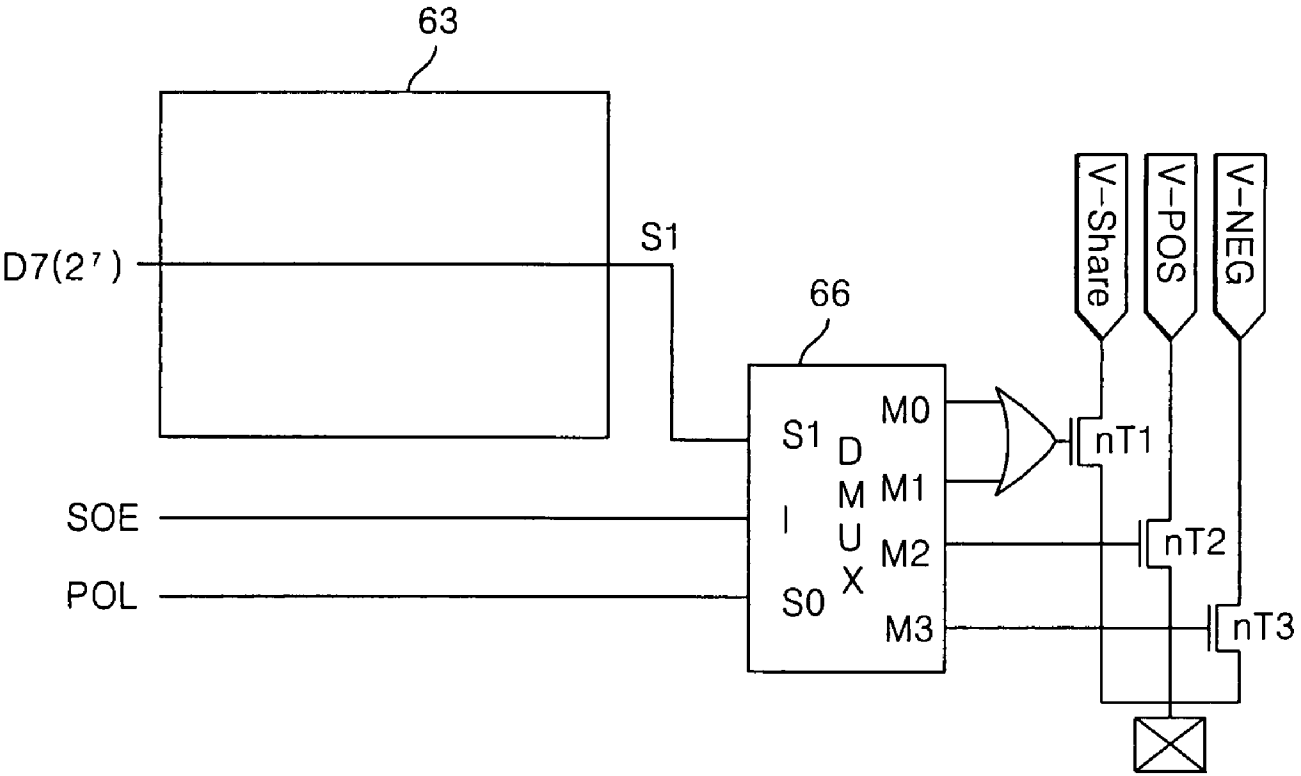
FIG. 8 is a circuit diagram representing a first example of a comparator shown in FIG. 6.

The comparator 63, according to a first example as shown in FIG. 8, inputs a D7 bit of a weight value $2^7$, which is a high logic value when the grey level is 127 or more, and as a low logic when the grey level is less than 127, to a S1 input terminal of the DMUX 66. Accordingly, the comparator 63 of this example may be realized with only a connecting line for supplying the D7 bit. The data IC according to the example, reduces the load of the data IC by charging the data line with the high pre-charge V-POS or VNEG when the data voltage represents a gray level of 127 or more, and by charging the data line with the low charge share voltage V-Share when the data voltage represents a gray level of less than 127.

Figure 9:
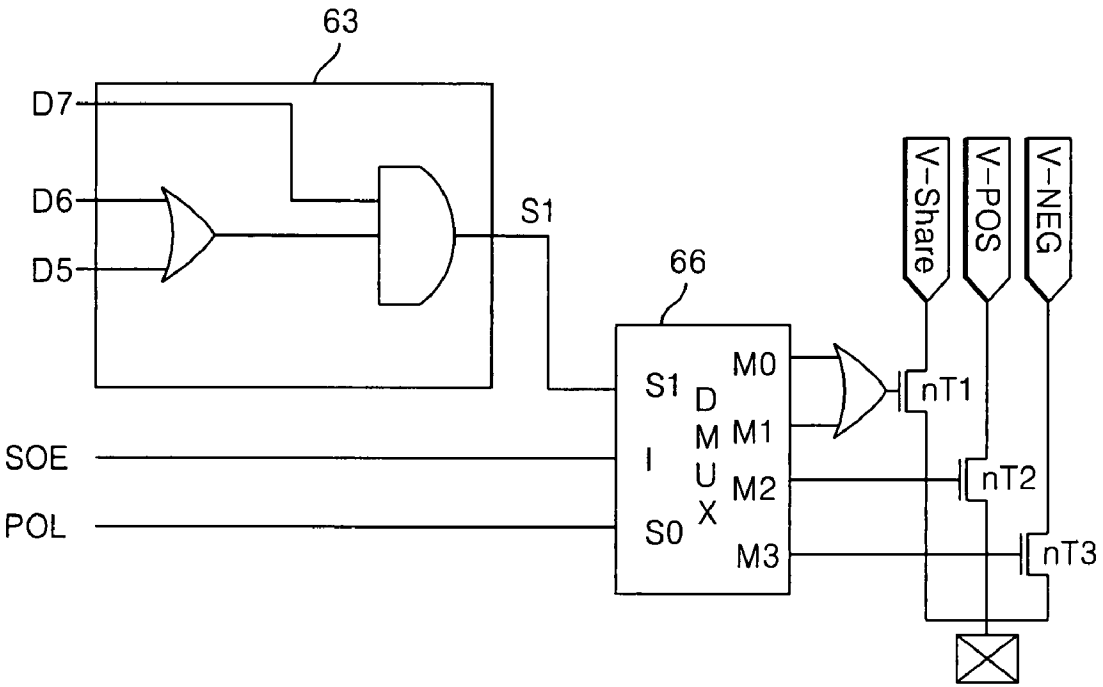
FIG. 9 is a circuit diagram representing a second example of a comparator shown in FIG. 6.

The comparator 63, according to a second example as shown in FIG. 9, includes an OR gate which performs a logical sum operation on a D6 bit of a weight value $2^6$ and a D5 bit of a weight value $2^5$, and an AND gate which performs a logical multiply operation on the output of the OR gate and the D7 bit of a weight value $2^7$. The AND gate output of the comparator 63 is a high logical value where the gray level is 160 or more and as a low logical value where the gray level is less than 160, and is inputted to the S1 input terminal of the DMUX 66. Accordingly, the comparator 63 of this example may be realized as two logic gate devices. In the data IC according to this example, the load of the data IC by is reduced by charging the data line with the high pre-charge V-POS or V-NEG when the grey level is 160 or more, and by charging the data line with the low charge share voltage V-Share when the gray level is less than 160.

Figure 10:
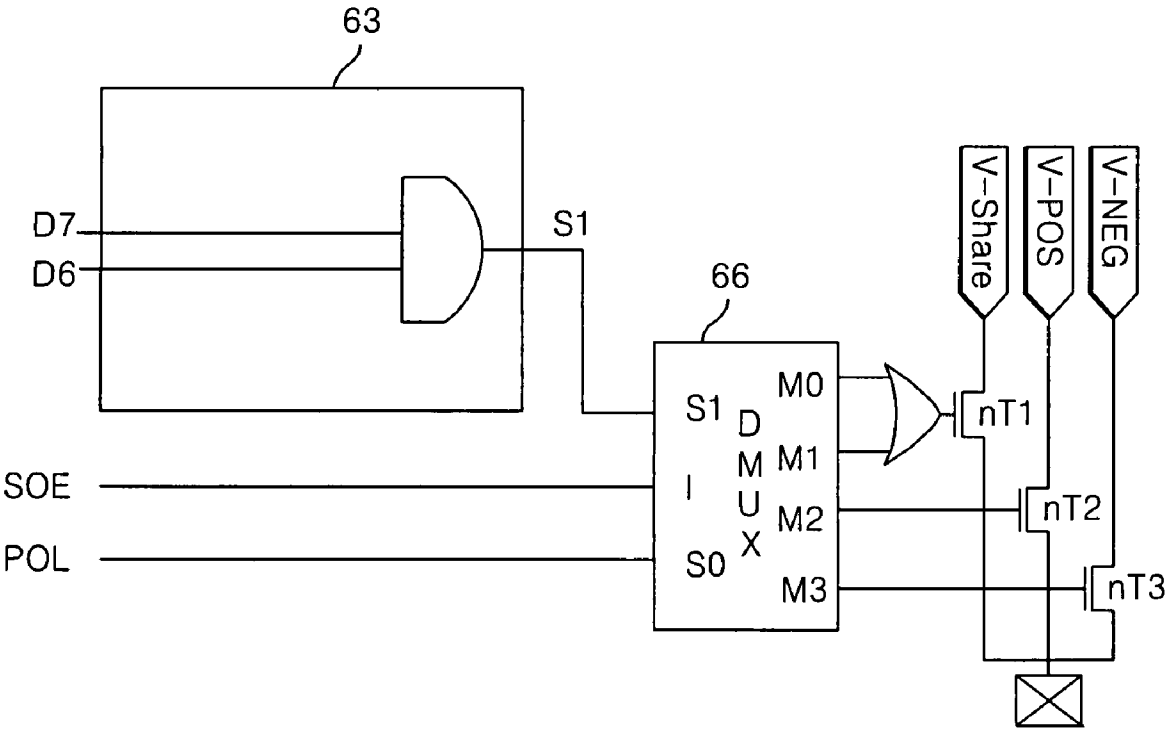
FIG. 10 is a circuit diagram representing a third example of a comparator shown in FIG. 6.

The comparator 63, according to a third example of the present invention as shown in FIG. 10, includes an AND gate which performs a logical multiply operation on the D6 bit of a weight value $2^6$ and the D7 bit of a weight value $2^7$. The AND gate output of the comparator 63 is generated as a high logic level when the gray level is 191 or more and as a low logic level when the gray level is less than 191, and being inputted to the S1 input terminal of the DMUX 66. Accordingly, the comparator 63 of this embodiment may be realized as one logic gate device. The data IC reduces the heat load and power consumption of the data IC by charging the data line with the high pre-charge V-POS or V-NEG when the gray scale voltage is 191 or more, and by charging the data line with the low charge share voltage V-Share in the gray scale voltage is less than 191.

Figure 11:
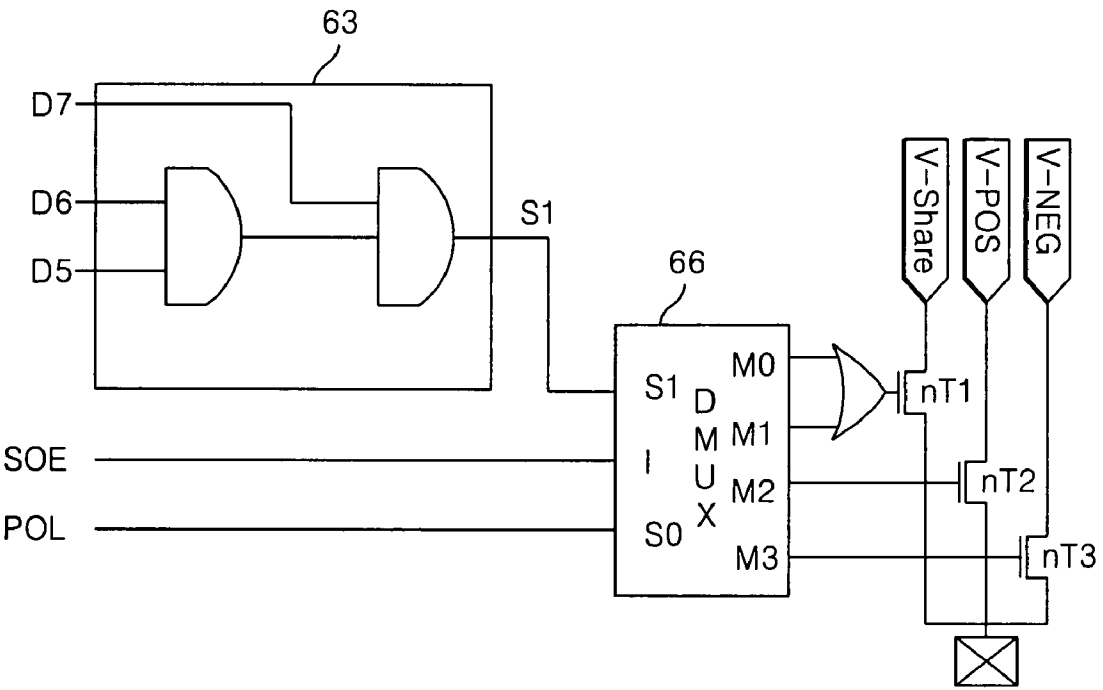
FIG. 11 is a circuit diagram representing a fourth example of a comparator shown in FIG. 6.

The comparator 63, according to a fourth example as shown in FIG. 11, includes a first AND gate which performs a logical multiply operation on a D6 bit of a weight value $2^6$ and a D5 bit of a weight value $2^5$, and a second AND gate which performs a logical multiply operation on the output of the first AND gate and the D7 bit of a weight value $2^7$. In this example, the AND gate output of the comparator 63 is generated as a high logical value when the gray scale voltage is 224 or more and as a low logical value when the gray scale voltage is less than 224 gray levels and inputted to the S1 input terminal of the DMUX 66. Accordingly, the comparator 63 of this embodiment may be realized as two logic gate devices. The data IC reduces of this example the heat load and power consumption of the data IC by charging the data line with the high pre-charge V-POS or V-NEG when the gray scale value is 224 or more, and by charging the data line with the low charge share voltage V-Share when the gray scale value is less than 224.

In an aspect where digital data represents a gray scale value of 256 (1111 1111), the output of the comparator 63 becomes the high logical value, and when the polarity control signal POL is the high logical value, the first data line of the liquid crystal display panel is pre-charged with the positive pre-charge voltage V-POS. If the second digital data adjacent to the first digital data is equal to the first digital data, i.e., (1111 1111), only the polarity control signal is inverted so that the second data line of the liquid crystal display panel is pre-charged with the negative pre-charge voltage V-NEG. If the third digital data adjacent to the second digital data and the fourth digital data adjacent to the third digital data are gray level of 63 (0011 1111), the output of the comparator 63 is inverted to the low logic value, so that the third and fourth data line of the liquid crystal display panel are pre-charged with the charge-share voltage V-Share.

Figure 12:
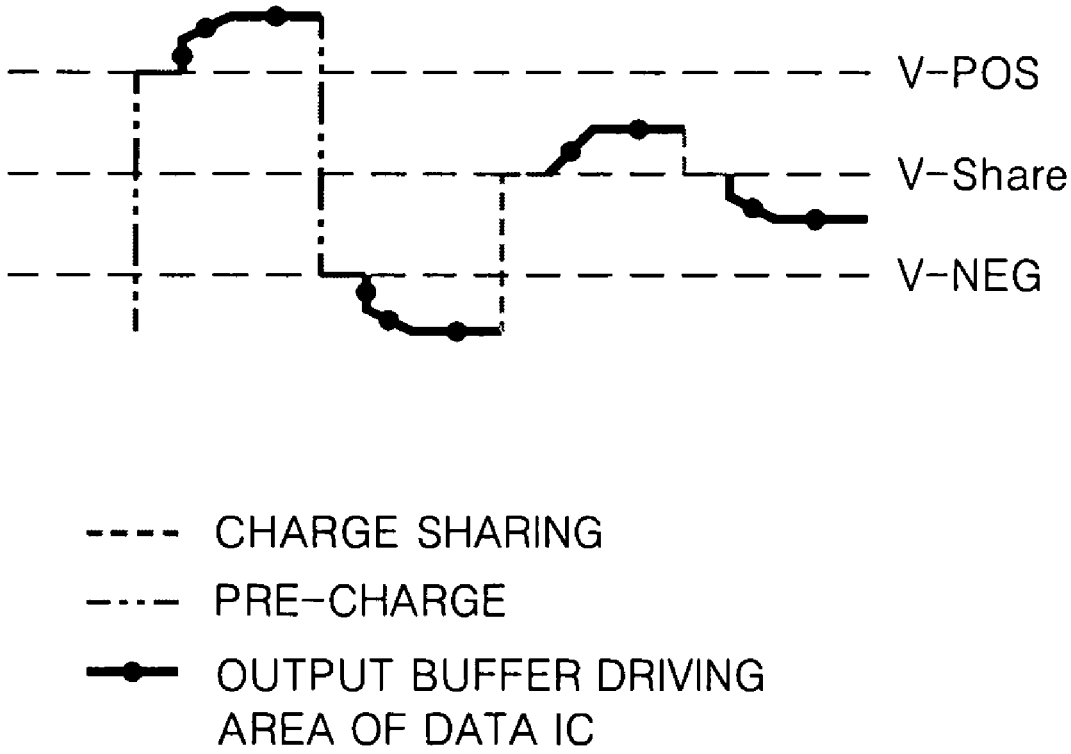
FIG. 12 is a waveform diagram representing an example of a waveform outputted from a data integrated circuit of the liquid crystal display device.

As shown in FIG. 12, the data IC uses a pre-charge function if the data voltage of high-voltage is inputted and uses a charge-share function when the data voltage of relatively low voltage is inputted, so as to reduce an overall current consumption of the output buffer, thereby enabling to reduce the power dissipation and temperature of the data IC.

As described above, the liquid crystal display device and the driving method thereof according to the present invention selectively uses the pre-charge voltage and the charge share voltage in accordance with the gray scale data values, and thus it is possible to lower the operating temperature of the data integrated circuit and to reduce the power consumption.

Although the present invention has been explained by the examples shown in the drawings described above, it should be understood to the ordinary skilled person in the art that the invention is not limited to these embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a comparator which processes a data value; and a pre-charge controller which pre-charges a data line of a liquid crystal display panel with a pre-charge voltage if the data value is a first value, and pre-charges the data line with a charge share voltage, which has a lower absolute voltage value than the pre-charge voltage if the data value is a second value and the second data value is lower than the first data value, wherein the pre-charge controller includes:

a source output enable signal and a polarity control signal for controlling a polarity of the data value, which are inputted thereto;

a de-multiplexer which outputs the source output enable signal to any one of a plurality of output terminals in accordance with an output of the comparator and an output of the polarity control signal;

a first transistor for supplying the charge share voltage to the data line in accordance with the output of the de-multiplexer if the data value is the second value;

a second transistor for supplying a positive pre-charge voltage to the data line in accordance with the output of the de-multiplexer if the data value is the first value; and a third transistor for supplying a negative pre-charge voltage to the data line in accordance with the output of the de-multiplexer if the data value is the first value.

2. The liquid crystal display device according to claim 1, wherein the comparator and the pre-charge controller are portions of an integrated circuit for driving the data line.

3. The liquid crystal display device according to claim 1, wherein the comparator includes:

a signal wire line for supplying any one of bits of the data to the de-multiplexer.

4. The liquid crystal display device according to claim 1, wherein the comparator includes:

at least one or more gate devices for performing a logical sum operation on the upper bits of the data.

5. The liquid crystal display device according to claim 4, wherein the comparator includes:

an OR gate for performing a logical sum operation on a first upper bit of a weight value $2^5$ and a second upper bit of a weight value $2^6$ of the data; and an AND gate for performing a logical multiply operation on an output of the OR gate and a third upper bit of a weight value $2^7$ of the data.

6. The liquid crystal display device according to claim 4, wherein the comparator includes:

an AND gate for performing a logical multiply operation on a first upper bit of a weight value $2^6$ and a second upper bit of a weight value $2^7$ of the data.

7. The liquid crystal display device according to claim 1, wherein the comparator includes:

a first AND gate for performing a logical multiply operation on a first upper bit of a weight value "$2^5$" and a second upper bit of a weight value "$2^6$" of the data; and a second AND gate for performing a logical multiply operation on an output of the first AND gate and a third upper bit of a weight value "$2^7$" of the data.

8. The liquid crystal display device according to claim 1, wherein the first value is any one of a high data value of 127 or more gray levels, a high data value of 160 or more gray levels, a high data value of 191 or more gray levels and a high data value of 224 or more gray levels, and the corresponding second value is any one of a low data value of less than 127 gray levels, a low data value of less than 160 gray levels, a data value of less than 191 gray levels and a data value of less than 224 gray levels, respectively.

9. The liquid crystal display device according to claim 1, wherein the charge share voltage includes:

at least two or more charge share voltages, and the charge share voltages differ from each other within a voltage range that is lower in absolute value than the pre-charge voltage.

10. A driving method of a liquid crystal display device, the method comprising of:

judging a voltage of data;

pre-charging a data line of a liquid crystal display panel with a pre-charge voltage if the voltage of the data is a first voltage; and pre-charging the data line with a charge share voltage which is lower in absolute value than the pre-charge voltage if the voltage of the data is a second voltage which is lower than the first voltage, wherein the pre-charge controller includes:

a source output enable signal and a polarity control signal for controlling a polarity of the data value, which are inputted thereto;

a de-multiplexer which outputs the source output enable signal to any one of a plurality of output terminals in accordance with an output of the comparator and an output of the polarity control signal;

a first transistor for supplying the charge share voltage to the data line in accordance with the output of the de-multiplexer if the data value is the second value a second transistor for supplying a positive pre-charge voltage to the data line in accordance with the output of the de-multiplexer if the data value is the first value; and a third transistor for supplying a negative pre-charge voltage to the data line in accordance with the output of the de-multiplexer if the data value is the first value.

11. The driving method according to claim 10, wherein the first voltage is any one of a high data voltage of 127 or more gray levels, a high data voltage of 160 or more gray levels, a high data voltage of 191 or more gray levels and a high data voltage of 224 or more gray levels, and the corresponding second voltage is any one of a low data voltage of less than 127 gray levels, a low data voltage of less than 160 gray levels, a data voltage of less than 191 gray levels and a data voltage of less than 224 gray levels, respectively.

12. The driving method according to claim 10, wherein the charge share voltage includes:

at least two or more charge share voltages, and the charge share voltages differ from each other within a voltage range that is lower in absolute value than the pre-charge voltage.

* * * * *

UNITED STATES PATENT AND TRADEMARK OFFICE

CERTIFICATE OF CORRECTION

PATENT NO. : 7,643,002 B2
APPLICATION NO. : 11/320387
DATED : January 5, 2010
INVENTOR(S) : Kang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1014 days.

Signed and Sealed this

Sixteenth Day of November, 2010

David J. Kappos

David J. Kappos
*Director of the United States Patent and Trademark Office*